US005368509A

United States Patent [19]

Tsujii

[11] Patent Number: 5,368,509

[45] Date of Patent: Nov. 29, 1994

[54] TILT LOCK SYSTEM FOR OUTBOARD MOTOR

[75] Inventor: Eiichiro Tsujii, Hamamatsu, Japan

[73] Assignee: Sanshin Kogyo Kabushiki Kaisha, Hamamatsau, Japan

[21] Appl. No.: 18,022

[22] Filed: Feb. 16, 1993

[30] Foreign Application Priority Data

Feb. 26, 1992 [JP] Japan ..... 4-075439

[51] Int. Cl.[5] ..... B63H 21/26

[52] U.S. Cl. ..... 440/56; 137/630.2

[58] Field of Search ..... 440/55, 56, 61, 53; 137/523, 630.2

[56] References Cited

U.S. PATENT DOCUMENTS

| | | | |
|---|---|---|---|
| 4,121,736 | 10/1978 | McGaw, Jr. | 137/630.2 X |
| 4,605,377 | 8/1986 | Wenstadt | 440/53 |
| 4,784,625 | 11/1988 | Nakahama | 440/61 |
| 4,925,411 | 5/1990 | Burmeister | 440/61 |
| 4,944,705 | 7/1990 | Kashima et al. | 440/61 |

FOREIGN PATENT DOCUMENTS

| | | | |
|---|---|---|---|
| 0153693 | 9/1984 | Japan | 440/61 |
| 60-116592 | 6/1985 | Japan . | |

*Primary Examiner*—Sherman Basinger

*Attorney, Agent, or Firm*—Knobbe, Martens, Olson & Bear

[57] ABSTRACT

A hydraulic tilt lock mechanism for a marine outboard drive that resists popping up operation when the outboard drive is operated in reverse but permits the outboard drive to pop up when an underwater obstacle is struck with sufficient force when traveling in a forward direction. A bypass passage is provided for selectively bypassing the shock absorbing function of the tilt lock mechanism to permit manual tilt and trim up and tilt and trim down operation. A control valve arrangement for controlling the flow through this bypass passage is incorporated which includes an operator that moves along an axis that is parallel to the cylinder bore of the hydraulic tilt lock mechanism and thus affords a compact and easily accessed construction.

9 Claims, 6 Drawing Sheets

TILT LOCK SYSTEM FOR OUTBOARD MOTOR

BACKGROUND OF THE INVENTION

This invention relates to a tilt lock system for an outboard motor and more particularly to an improved mechanism for operating the hydraulic system of a tilt lock system.

It is well known in marine propulsion units to include a hydraulic cylinder, piston assembly that is interposed between the outboard drive and the transom of the associated watercraft. This assembly functions to hold the outboard drive against popping up when traveling in reverse thrust but, at the same time, permitting the outboard drive to pop up when traveling forwardly and when an underwater obstacle is struck.

With this type of mechanism, it has also been proposed to provide a valve assembly which when opened permits flow through the hydraulic cylinder assembly so that the outboard drive can be manually tilted up without having to act against the resistance of the hydraulic cylinder. Such an arrangement is shown in U.S. Pat. No. 4,784,625 issued Nov. 15, 1988 and entitled "Tilt Lock Mechanism For Marine Propulsion Device." In the arrangement shown in that patent, there is a separate accumulator chamber that communicates with the two chambers of the hydraulic cylinder and check valves normally restrict the flow in one direction or the other from the hydraulic cylinder to or from the accumulator. An actuating mechanism including a rotary cam is employed for opening the check valves and permitting the unencumbered tilting up operation as described.

Although the system described in that patent is quite effective, the manual control valve that is employed to permit ease of tilting up has its operating axis disposed generally at a right angle to the axis of the hydraulic cylinder. Since this type of mechanism is normally placed between the swivel and clamping brackets of the outboard drive, this makes the valve actuator difficult to access. In addition, this type of construction adds some bulk to the overall assembly, which is not desirable.

It is, therefore, a principal object of this invention to provide an improved tilt lock mechanism for an outboard drive.

It is a further object of this invention to provide a tilt lock mechanism for an outboard drive having a release valve and operator wherein the operator will be easily accessed and the construction is nevertheless compact.

It is a further object of this invention to provide an improved release mechanism for a tilt lock cylinder of a marine outboard drive.

SUMMARY OF THE INVENTION

This invention is adapted to be embodied in a hydraulic tilt lock system for a marine outboard drive which is adapted to be mounted on the transom of a watercraft for controlling the movement of the outboard drive relative to the watercraft. The tilt lock system is comprised of a cylinder housing that is adapted to be affixed to one of the outboard drive and the transom and which defines a cylinder bore. A piston is supported for reciprocation in the cylinder bore and with the cylinder bore defines at least one fluid chamber. Means affix the piston to the other of the outboard drive and the transom for varying the volume of the fluid chamber in response to relative movement between the piston and cylinder assembly upon movement of the outboard drive relative to the transom. A passage communicates with the fluid chamber and valve means control the flow through the passage. An operator is provided for controlling the valve means and is moveable along an axis that is disposed parallel to the axis of the cylinder bore.

DETAILED DESCRIPTION OF THE PREFERRED EMBODIMENT OF THE INVENTION

Figure 1:
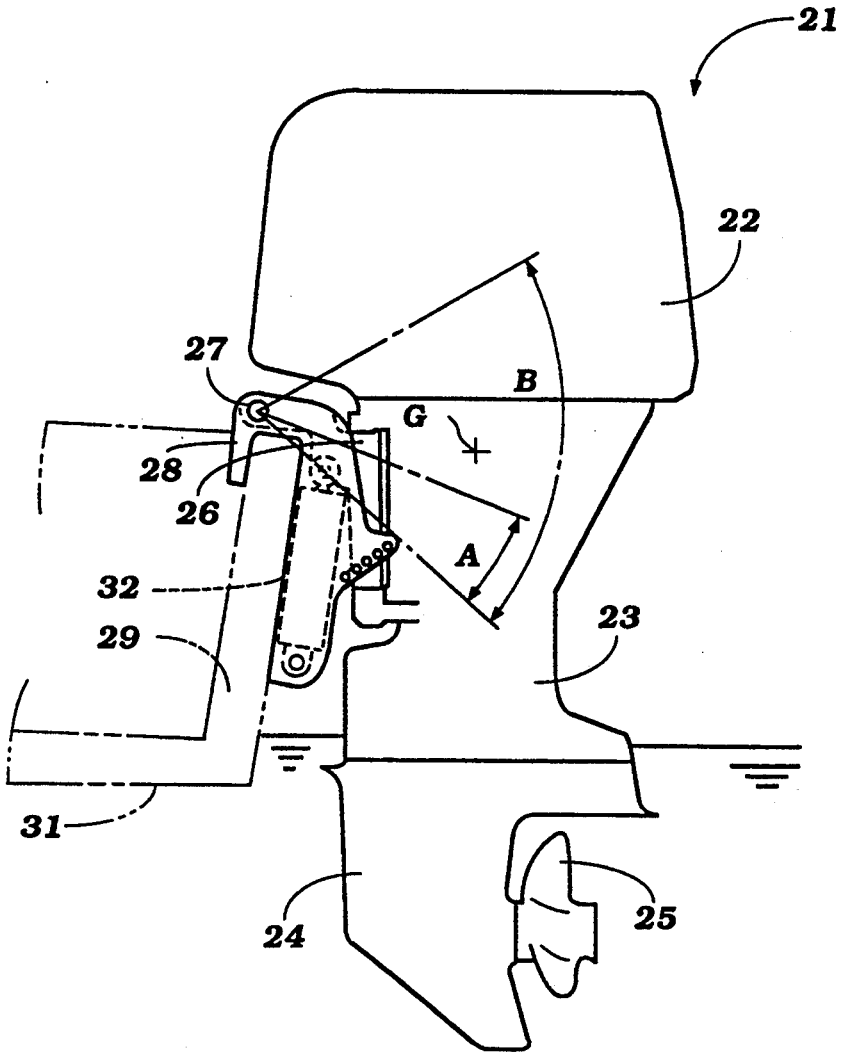
FIG. 1 is a side elevational view of an outboard motor attached to the transom of an associated watercraft.

Referring now in detail to the drawings and initially primarily to FIG. 1, an outboard motor having a tilt lock mechanism constructed in accordance with an embodiment of the invention as identified generally by the reference numeral 21. Although the tilt lock mechanism is shown in conjunction with an outboard motor, it is to be understood that the invention may also be used with the outboard drive portion of a marine inboard/-outboard drive. However, the invention has particular utility and will be used more frequently in connection with outboard motors. The term outboard drive is used generically herein to encompass both outboard motors and the outboard drive portion of all inboard/outboard marine driving system.

The outboard motor 21 may be considered to be conventional and for that reason only its major components will be described. These include a power head 22 that contains a powering internal combustion engine and a surrounding protective cowling. A driveshaft housing 23 depends from the power head 22 and rotatably journals a driveshaft driven by the engine output shaft. A lower unit 24 is positioned at the bottom of the driveshaft housing 23 and contains a propeller 25 that is driven through a suitable transmission contained within the lower unit and driven by the aforenoted driveshaft.

Figure 2:
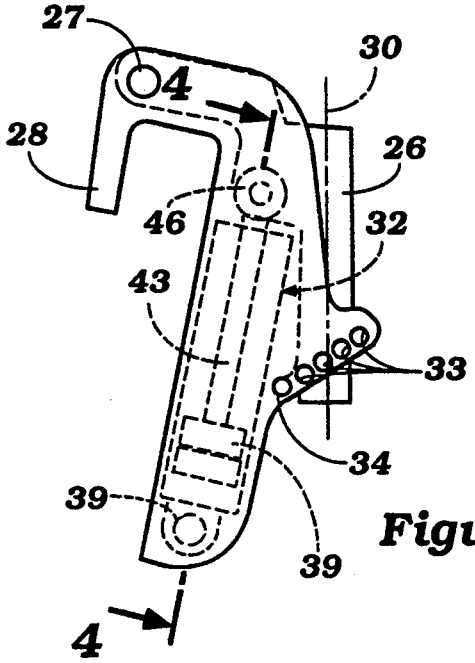
FIG. 2 is an enlarged side elevational view of the tilt lock mechanism in the normal driving condition.
Figure 3:
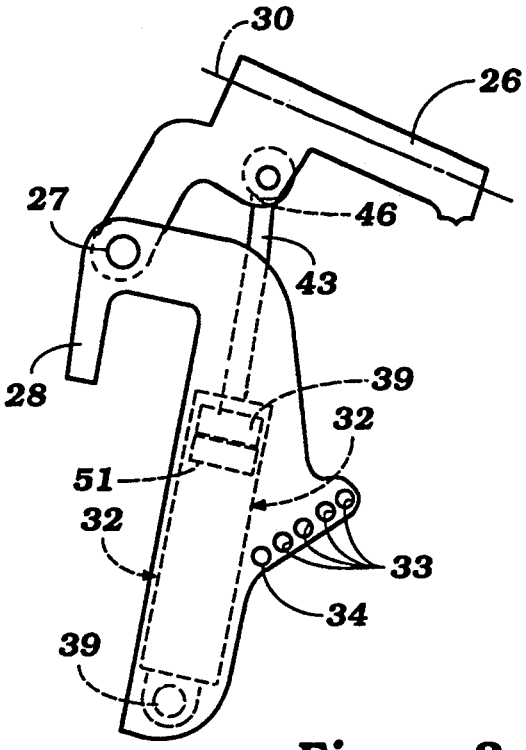
FIG. 3 is a side elevational view, in part similar to FIG. 2, showing the unit tilted up.

A steering shaft (not shown) is affixed to the driveshaft housing 23 and is rotatably journaled within a swivel bracket 26. This movement accommodates steering motion of the outboard motor 21 about a steering axis 30 (FIGS. 2 and 3). The swivel bracket 26 is, in turn, pivotally connected by means of a pivot pin 27 to a clamping bracket 28. The pivot pin 27 has a horizontally disposed axis and accommodates tilt and trim motion of the outboard motor 21. The normal range of trim movement is shown by the arc "A" and the tilt up operation is shown by the arc "B". The clamping bracket 28 includes an appropriate device for clamping it and the outboard motor 21 to a transom 29 of an associated watercraft 31, which transom and watercraft are shown in phantom.

A tilt lock cylinder assembly 32 is interposed between the swivel bracket 26 and clamping bracket 28 for holding the outboard motor 21 against popping up when operating in a reverse mode. The tilt lock mechanism 32 will, however, permit the outboard motor 21 to pop when an underwater obstacle is struck and then return to the trim adjusted position once the underwater obstacle is cleared.

Referring now additionally to FIGS. 2 and 3, it will be noted that the clamping bracket 28 is provided with a plurality of spaced apertures 33 which are designed to accommodate a trim adjusting pin 34 which is placed in pairs of aligned apertures 33 of the clamping bracket 28 so as to be engaged by the swivel bracket 26 and control the trim adjusted position of the outboard motor. FIG. 2 shows the position of the clamping bracket 28 and tilt lock mechanism 32 when the outboard motor 21 is in its fully trimed down condition. FIG. 3 shows the condition when the outboard motor is tilted up to an out of the water position.

Figure 4:
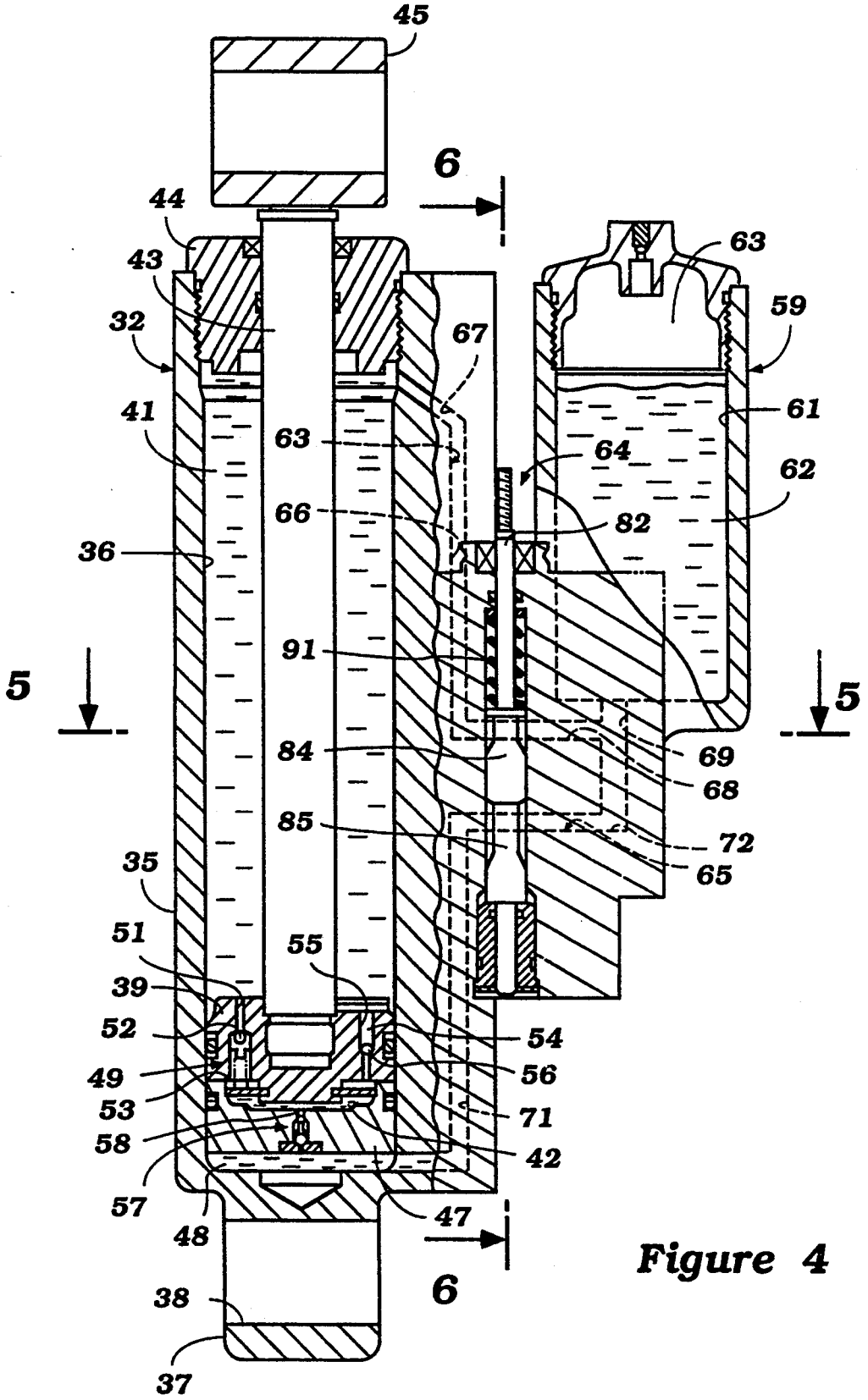
FIG. 4 is an enlarged cross sectional view taken along the line 4—4 of FIG. 2.
Figure 5:
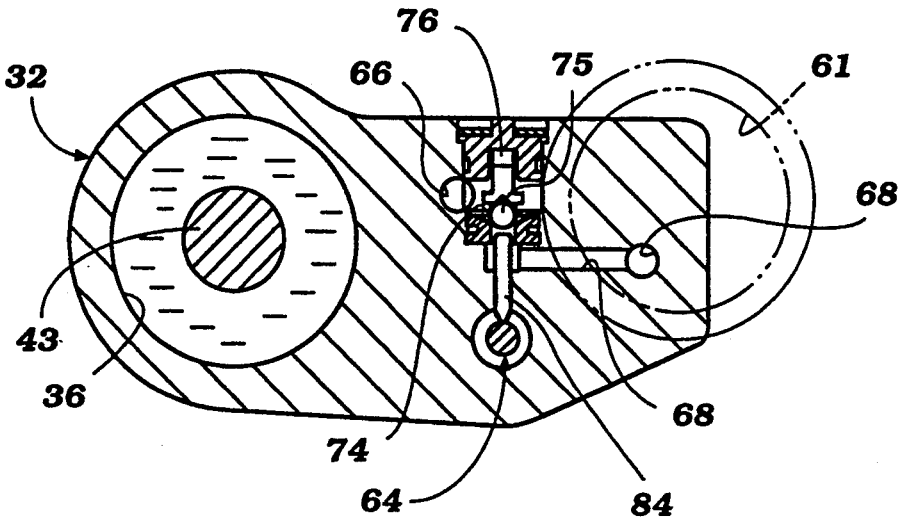
FIG. 5 is a cross sectional view taken along the line 5—5 of FIG. 4.

The tilt locking mechanism 32 will now be described in detail by particular reference to FIGS. 4 through 6. It should be understood, however, that FIGS. 1 through 3 show how the tilt locking mechanism 32 is associated with the clamping bracket 28 and swivel bracket 26.

The tilt locking mechanism 32 includes a cylinder housing assembly comprised of a main cylinder part 35 which defines a cylinder bore 36 which extends in a generally vertical direction. The cylinder housing 35 is provided with a trunnion 37 having a bore 38 that is adapted to receive a pivot pin 39 (FIGS. 2 and 3) that passes between the sides of the clamping bracket 28 so as to pivotally connect the cylinder housing 35 to the clamping bracket 28.

A piston 39 is slidably supported within the cylinder bore 36 and defines an upper chamber 41 and a lower chamber 42 both of which are filled with hydraulic fluid. A piston rod 43 is affixed to the piston 39 and extends through a closure plug 44 fixed in the upper end of the cylinder housing 35 for closing the cylinder bore 36. The projecting end of the piston rod 43 is provided with a trunnion 45 that receives a pivot pin 46 (FIGS. 2 and 3) for pivotal connection to the swivel bracket 26.

A floating piston 47 is positioned in the lower chamber 42 and defines a further chamber 48 below the floating piston 47. The floating piston 47 is normally abuttingly engaged with the piston 39 and will control its downward position. The chambers 42 and 48 are also filled with hydraulic fluid.

An absorber valve, indicated generally by the reference numeral 49 is provided in the piston 39 for permitting flow from the chamber 41 to the chamber 42 when an underwater obstacle is struck with sufficient force. The absorber valve 39, however, requires sufficient force to open it so that it will not permit the outboard motor 21 to pop up when traveling in reverse. The absorber valve 49 is comprised of a passageway 51 that extends from the chamber 41 and which is normally closed by a ball type valve 52 that is held in its closed position by means of a coil compression spring 53. The compression spring 53 sets the pressure at which the absorber valve 49 will open.

A return valve, indicated generally by the reference numeral 54 is provided for permitting fluid flow from the chamber 42 back to the chamber 41 when the underwater obstacle is cleared. The return valve 54 is comprised of a passageway 55 in which a ball type check valve 56 is positioned and which extends between the chambers 41 and 42. A light return spring (not shown) holds the ball valve 56 in its closed position but is adapted to open under relatively low pressures as exerted by the weight of the outboard motor 21 once the underwater obstacle is cleared. As seen in FIG. 1, the center of gravity "G" of the outboard motor 21 is disposed rearwardly of the horizontal tilt axis defined by the pivot pin 27 so that the weight of the outboard motor 21 will tend to cause it to move downwardly.

A further check valve 57 is provided in the floating piston 47 and controls the flow through a small passageway 58 so as to permit the fluid flow from the chamber 48 to the chamber 42 but not flow in the reverse direction.

Because the piston rod 43 extends in the chamber 41 and thus displaces some of the fluid from it, there will be less fluid displaced from the chamber 41 than is required to make up the volume in the chamber 42 as the piston 39 moves upwardly. To compensate for this change in fluid volume, an accumulator assembly, indicated generally by the reference numeral 59 is formed integrally with the cylinder housing 35. The accumulator assembly comprises a chamber 61 in which hydraulic fluid 62 is positioned. In addition, a pressurized inert gas such as nitrogen 63 is charged in the bore over the fluid 62. If desired, adequate pressure may be stored in the accumulator chamber 61 so as to provide some lift assistance during tilt up operation, as will become apparent.

An upper bypass passageway 63 communicates the upper end of the chamber 41 with the accumulator chamber through a control valve assembly, indicated generally by the reference numeral 64. In a similar manner, a passageway, indicated generally by the reference numeral 65 communicates the lower portion of the lower chamber 48 with the accumulator chamber 61 with the control valve 64 also controlling the flow through this passageway 65.

The passageway 63 includes a first portion 66 that extends generally parallel to the cylinder bore 36 and is joined to it by an angled upper passageway 67. At the lower end of the passageway 66, a cross drilled passageway 68 communicates with the accumulator chamber 61 through a further passageway 69 that extends parallel to the cylinder bore 36 and accumulator chamber 61.

In a similar manner, the lower passageway 65 is comprised of a vertically extending portion 71 which communicates at its lower end with the chamber 48 and at its upper end with a cross drilled passageway 72 which also intersects the passageway 69 and thus communicates with the accumulator chamber 61. The control valve 64, however, closes the passageway portion 69 and 72 in a manner as may be best understood by reference to FIGS. 5 and 6.

The control valve assembly 64 includes a first or upper ball type check valve, indicated generally by the reference numeral 73 which is positioned in a bore that intersects each of the passages 66 and 68 and which includes a ball check valve seat 74 having a passageway which is normally closed by a ball type valve 75 which is held in its closed position by coil compression spring 76. In this closed position, the flow from the upper cylinder chamber to the accumulator chamber 61 is precluded. However, fluid may flow in the opposite direction if sufficient pressure difference is generated so as to unseat the ball check valve 75.

The valve assembly 64 further includes a lower ball type check valve, indicated generally by the reference numeral 77 which is positioned in a bore that intersects the passages 71 and 72, respectively. This check valve 77 includes a valve seat 78 having a passage which is normally closed by a ball type check valve 79 that is normally urged to its closed position by a coil compression spring 81. The check valve assembly 77 is such that it will permit fluid flow from the accumulator chamber 61 to the lower cylinder chamber 48 when a predetermined pressure difference exists but will preclude flow in the reverse direction.

The control valve assembly 64 also includes means for selectively and manually opening either the check valve 73 or the check valve 73 and the check valve 77. This actuating means includes an actuating rod 82 that is slidably supported in a bore 83 which extends parallel to the cylinder bore 36 and thus is generally vertically disposed. The actuating rod 82 has affixed to it an upper cam 84 and a lower cam 85 which cams have cylindrical portions 86 and 87, respectively that are of different axial lengths, for a reason to be described, with cam surfaces at their lower ends. These cam surfaces are adapted to engage actuating pins 88 and 89, respectively, which extend through openings in the valve seats 75 and 78, respectively, which openings are larger in diameter than the pins 88 and 89 so as to permit fluid flow therethrough.

Figure 6:
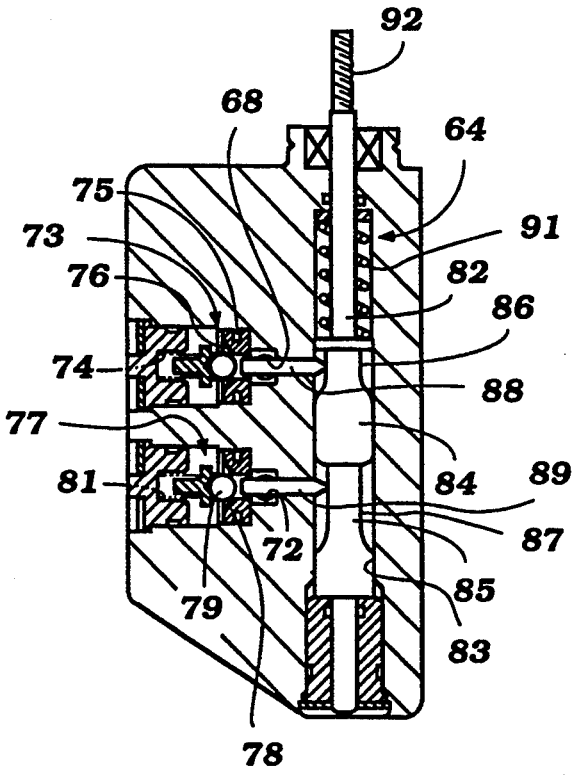
FIG. 6 is an enlarged cross sectional view taken along the line 6—6 of FIG. 4.

A coil compression spring 91 is received in the upper end of the bore 83 and normally urges the cams 84 and 85 to their lower normal positions as shown in FIG. 6. A wire actuator or other form of actuator may be connected to a threaded upper end 92 of the actuating rod 81 so as to draw it upwardly to first unseat the ball valve 74 and then to unseat the ball valve 79 if this is the desired mode of operation.

Figure 7:
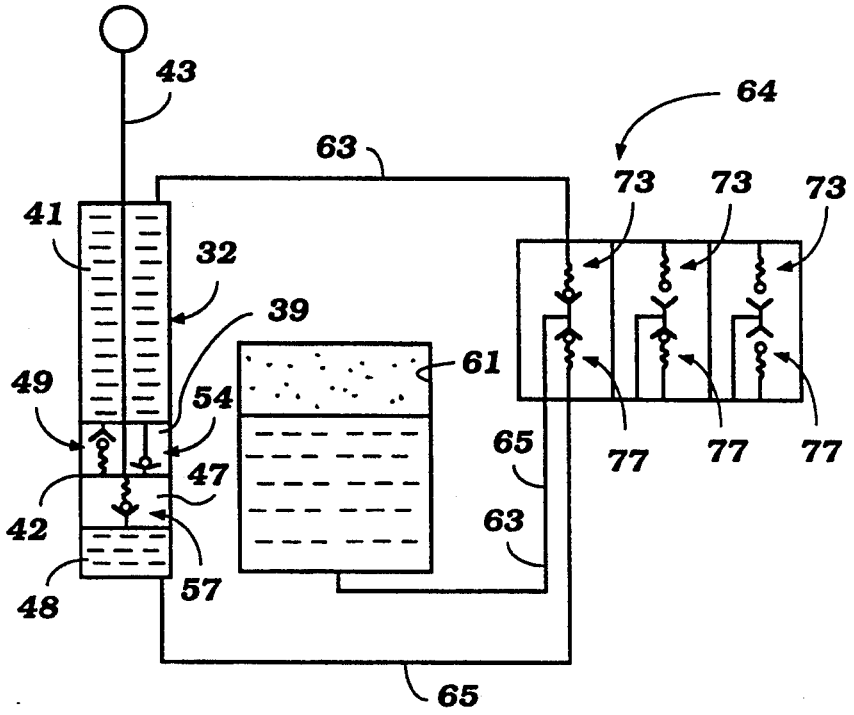
FIG. 7 is a schematic view showing the system and the operation when operating in a normal tilted down mode.

The operation of the device will now be described by reference to schematic FIGS. 7 through 10. Referring first to FIG. 7, this shows the system when the control valve 64 is in its normal position as shown in FIG. 6 and wherein the tilt lock mechanism 32 will operate to preclude popping during reverse operation and also to permit popping up when an underwater obstacle is struck and then returning to the normal trimmed condition once the underwater obstacle is cleared. As seen in FIG. 7, this condition of the control valve 64 places the check valves 73 and 77, respectively, in their positions so that they each will permit flow from the accumulator chamber 61 to the respective controlled chambers 41 and 48 under the conditions which will now be described.

FIG. 7 shows the device in a normal trim condition wherein the floating piston 57 is engaged with the moveable piston 39. If the outboard motor 21 is driven in reverse, there will be an upward force on the piston rod 43 and piston 39. However, the pressure setting of the absorber valve 49 is such that the outboard motor 21 will not tilt up under this condition.

Figure 8:
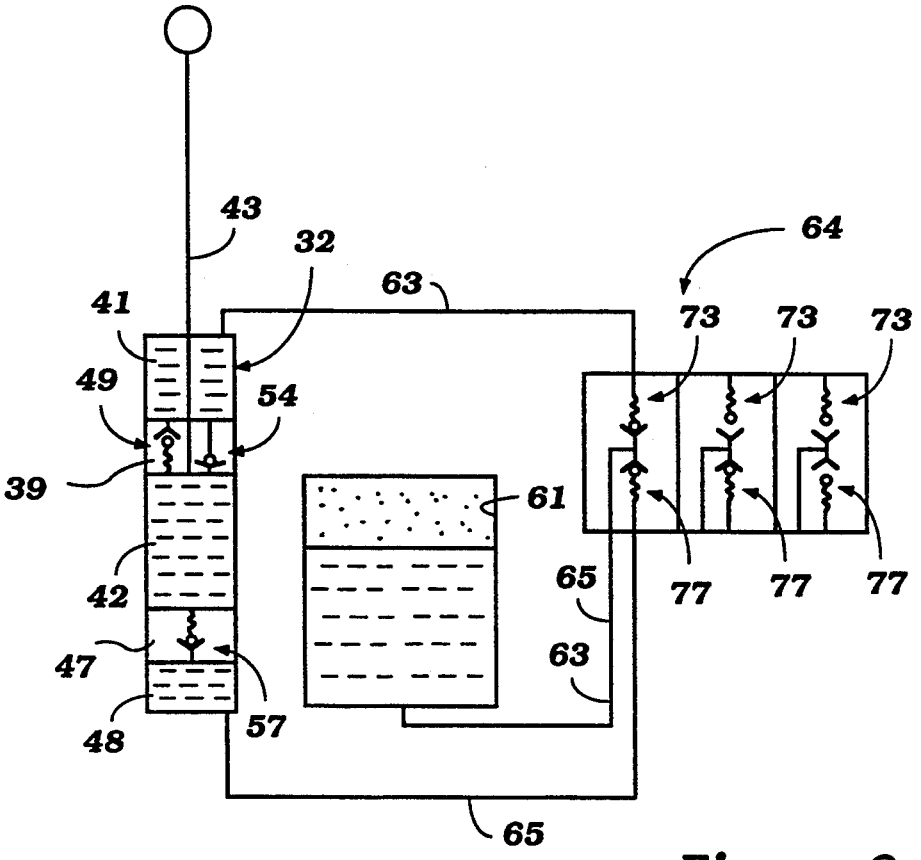
FIG. 8 is a schematic view, in part similar to FIG. 7, and shows the unit as it pops up when an underwater obstacle is struck.

If, however, an underwater obstacle is struck with sufficient force, the outboard motor will pivot up about the tilt pin axis 27 and the absorber valve 49 will open due to the increased pressure in the chamber 41 and permit fluid flow from the chamber 41 to the chamber 42 (FIG. 8). When this occurs, there will be less fluid displaced from the chamber 41 than required for expansion of the chamber 42 and fluid can flow from the accumulator chamber 61 for makeup purposes past the check valve 77 into the lower chamber 48 which may cause some slight upward movement of the floating piston 47. When the underwater is obstacle is cleared, the weight of the outboard motor acting on the piston 39 will unseat the lightly bias return valve 54 and the piston 39 can move downwardly to its previously adjusted trim position.

Figure 9:
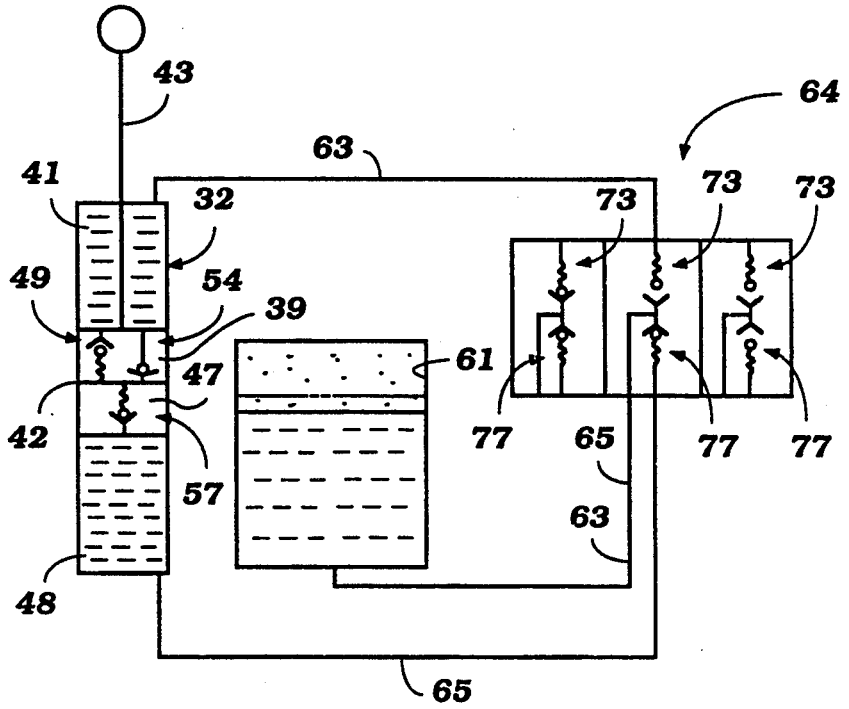
FIG. 9 is a view, in part similar to FIGS. 7 and 8, showing how the outboard motor may be manually tilted up without fluid resistance when the control valve is in the appropriate mood.

If the operator desires to tilt or trim up the outboard motor manually, he can accomplish this by operating the control valve 64 and specifically the operator rod 82 to move it upwardly to the position shown in FIG. 9 wherein the ball check valve 73 is unseated. This position is such that the ball check valve of the check valve assembly 77 will be left in position. Hence, when the operator pulls upwardly on the outboard motor, the piston 39 can move freely upwardly with fluid passing from the chamber 41 to the lower chamber 48 by opening of the ball check valve 77 (FIG. 9). This causes the floating piston 47 to follow the piston 39. Again, some makeup fluid is required because of the lesser volume of the chamber 41 than the chamber 48 due to the displacement of the piston rod 43 and this makeup fluid will also flow from the accumulator chamber 61.

Once the operator reaches the desired position, he can release the outboard motor and downward movement will be precluded because no fluid can be displaced from the lower piston chamber 48 to the upper chamber since the check valve 77 will preclude such reverse flow. Hence, the outboard motor will be held in its trim adjusted position or its tilted up position, which ever choice the operator makes. Under this condition, there can still be normal popping up action if an underwater obstacle is struck and assuming the outboard motor is still left in a position where the lower unit is submerged.

Figure 10:
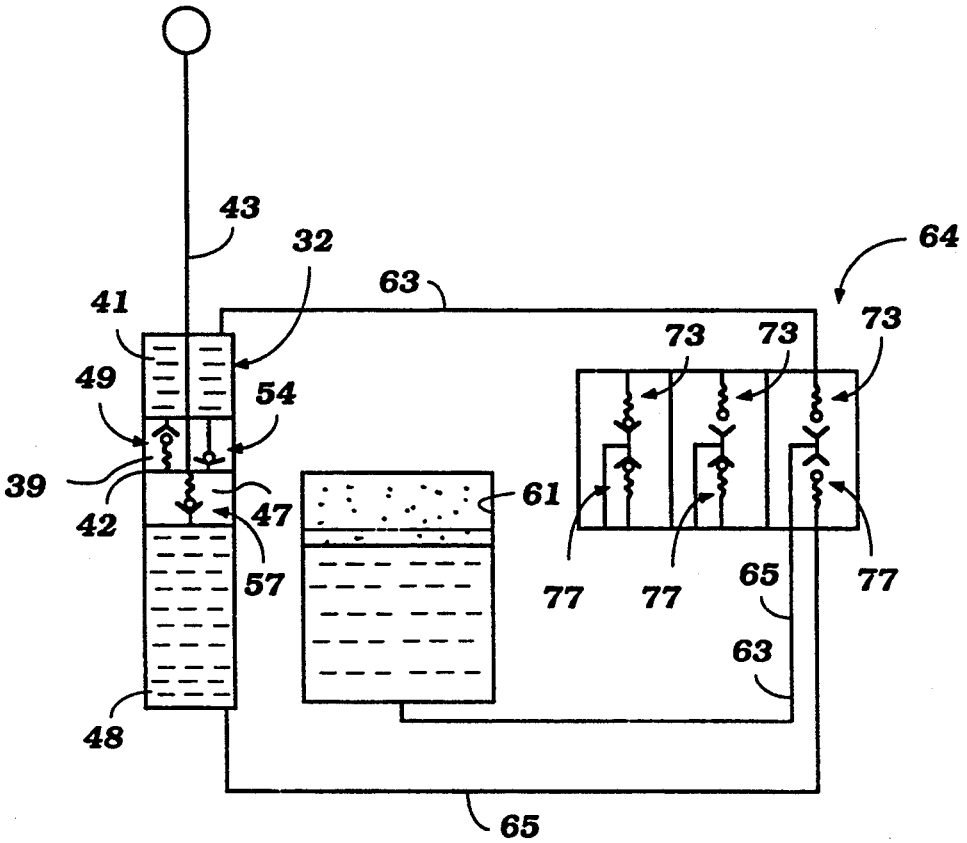
FIG. 10 is a view, in part similar to FIG. 7 through 9, and shows how the unit can be lowered manually.

If the operator desires to lower the outboard motor either from its tilted up out of the water position or from a trim position, the operator moves the control valve 64 and specifically its operating rod 82 upwardly so as to cause the cam 85 to unseat the ball check valve of the lower check valve assembly 77 (FIG. 10). When this occurs, the weight of the outboard motor itself will cause a force downwardly on the piston 39 which is transmitted through the floating piston 47 to drive fluid from the chamber 48 back to the accumulator 61 through the open check valve 77. Makeup fluid can be also delivered to the upper chamber 41 from the lower chamber 48 and since less fluid is required to fill the chamber 41 than is displaced in the chamber 48, there will be fluid flow back to the accumulator chamber 61. When the desired position is reached, the operator returns the control valve 64 to the normal position as shown in FIGS. 7 and 8.

It should be readily apparent from the described construction that the tilt lock mechanism described is extremely effective and very compact in that it has a control valve operator that moves along an axis that is parallel to the cylinder bore axis and thus permits ease of operation even though the unit is placed between the swivel and clamping brackets. Of course, the foregoing description is that of a preferred embodiment of the invention and various changes and modifications may be made without departing from the spirit and scope of the invention, as defined by the appended claims.

I claim:

1. A hydraulic tilt lock system for a marine outboard drive adapted to be mounted on the transom of a watercraft for controlling the movement of said outboard drive relative to the watercraft, said tilt lock being comprised of a cylinder housing assembly adapted to be affixed to one of said outboard and said transom, a cylinder bore formed in said cylinder housing assembly, a piston supported for reciprocation in said cylinder bore and with said cylinder bore defining a pair of fluid chambers, a piston rod affixed at one end to said piston and at the other end to the other of said outboard drive and said transom for varying the volume of said fluid chambers in response to the relative movement between said piston and said cylinder assembly upon movement of said outboard drive relative to said transom, said piston rod passing through one of said fluid chambers for displacing fluid therein, an accumulator chamber formed in said cylinder housing assembly at one side of said cylinder bore, a passage communicating said fluid chambers with each other and with said accumulator chamber, valve means supported in said cylinder housing assembly at a position longitudinally relative the axis of said cylinder bore between the ends of said cylinder bore and transversely between said cylinder bore and said accumulator chamber for controlling the flow through said passage, and an operator having a portion exposed from said cylinder housing assembly at an upper end thereof for direct operation by a user for controlling said valve means and moveable along an axis disposed parallel to the axis of said cylinder bore.

2. A hydraulic tilt lock system as set forth in claim 1 wherein the passage comprises a pair of passages each communicating the respective fluid chamber with the accumulator chamber and a valve is positioned in each passage.

3. A hydraulic tilt lock system as set forth in claim 2 wherein each valve includes a valve element moveable in a direction transverse to the direction of the operator.

4. A hydraulic tilt lock system as set forth in claim 3 wherein the valves comprise ball type check valves.

5. A hydraulic tilt lock system as set forth in claim 4 wherein the operator actuates a push rod that has a pair of cams each of which engages a respective one of the ball type check valves for opening the ball type check valve.

6. A hydraulic tilt lock system as set forth in claim 5 wherein each ball type check valve permits flow in one direction but precludes flow in a reverse direction when not opened by the push rod.

7. A hydraulic tilt lock system as set forth in claim 6 wherein each ball type check valve permits flow from the accumulator if sufficient pressure is generated.

8. A hydraulic tilt lock system as set forth in claim 2 wherein the operator portion extends through the upper surface of the cylinder housing assembly.

9. A hydraulic tilt lock system as set forth in claim 1 wherein the operator portion extends through the upper surface of the cylinder housing assembly.

* * * * *